US011439923B2

(12) United States Patent
Cho

(10) Patent No.: US 11,439,923 B2
(45) Date of Patent: Sep. 13, 2022

(54) SWIRL GENERATOR

(71) Applicant: Hamilton Sundstrand Corporation, Charlotte, NC (US)

(72) Inventor: Wei-Lin Cho, Unionville, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 487 days.

(21) Appl. No.: 16/679,909

(22) Filed: Nov. 11, 2019

(65) Prior Publication Data

US 2021/0138358 A1 May 13, 2021

(51) Int. Cl.
*B01B 1/00* (2006.01)
*F28F 9/24* (2006.01)

(52) U.S. Cl.
CPC ..... *B01B 1/005* (2013.01); *F28F 9/24* (2013.01)

(58) Field of Classification Search
CPC .... B01B 1/005; F28F 9/24; B04C 3/06; B01F 25/10; B05B 7/10
USPC ..... 366/165.5
See application file for complete search history.

(56) References Cited

U.S. PATENT DOCUMENTS 1,184,936 A * 5/1916 Falkenwalde ..... F28F 13/12 285/213
3,016,067 A * 1/1962 Edmonds ..... F28D 3/04 165/174
4,087,050 A * 5/1978 Tsuji ..... F23D 11/383 239/492
4,218,012 A * 8/1980 Hamza ..... B01F 25/10 239/10
4,248,296 A * 2/1981 Jezek ..... F28D 3/04 239/487
5,059,226 A 10/1991 Schneider et al.
6,958,107 B1 * 10/2005 Clarke ..... B04C 5/06 202/175
10,145,588 B2 12/2018 Nagano et al.
(Continued)

FOREIGN PATENT DOCUMENTS

CN 103267391 B 12/2015
CN 103423923 B 3/2016
(Continued)

OTHER PUBLICATIONS

European Search Report Issued in European Application No. 20205193.4-1002 dated Apr. 7, 2021; 6 Pages.

*Primary Examiner* — Jon T. Schermerhorn, Jr.
(74) *Attorney, Agent, or Firm* — Cantor Colburn LLP

(57) ABSTRACT

Disclosed is a swirl generator for an evaporator, having: a body that extends along a body-center axis between opposing inlet and outlet ends, and includes: a fluid inlet at the inlet end; an outer surface that, at that the outlet end, defines an outlet region with a curved outer boundary forming a convex curve that extends radially inward from an outer diameter surface of the body to an outer axial surface of the body; a center passage formed within the body that extends from the inlet towards the outlet along the body-center axis; and a swirl passage formed at the outlet end of the body, the swirl passage extending between the center passage and the curved outer boundary along a swirl passage axis, whereby a fluid entering from the inlet exits the body at the curved outer boundary, the swirl passage axis forming an acute angle with the body-center axis.

13 Claims, 4 Drawing Sheets

(56) References Cited

U.S. PATENT DOCUMENTS

| | | | | |
|---|---|---|---|---|
| 2005/0042042 | A1* | 2/2005 | Clarke | B01D 1/065 406/108 |
| 2018/0161793 | A1* | 6/2018 | Disimile | B64F 5/23 |
| 2020/0156023 | A1* | 5/2020 | Manda Venkata Naga | B01F 25/3131 |
| 2021/0231390 | A1* | 7/2021 | Cho | F28F 9/0246 |

FOREIGN PATENT DOCUMENTS

| | | | |
|---|---|---|---|
| JP | 2011025163 | A | 2/2011 |
| WO | 2005007297 | A1 | 1/2005 |
| WO | 2008010237 | A1 | 1/2008 |

* cited by examiner

SWIRL GENERATOR

BACKGROUND

The embodiments herein relate to an evaporator for evaporating a single-phase liquid or two-phase fluid in a refrigerant system and more specifically to a swirl generator for the evaporator.

A distributor, e.g., a header, in refrigeration systems receives single-phase liquid or two-phase refrigerant flow and divides it equally to provide uniform feed to all passages of an evaporator. Thus each passage of an evaporator in a refrigeration system should have an equal fluid mass flow rate of refrigerant in order for the refrigeration system to effectively to use the evaporator. In addition, the distributor is used to reduce flow from a larger area within the distributor to a smaller area in the individual evaporator paths. Under adverse gravity conditions of the type encountered in aerospace applications, characteristics of the flow dynamics into the evaporator passages from the distributor may result in reduced contact between the working fluid and the evaporator. This may reduce effectiveness of the system.

BRIEF SUMMARY

Disclosed is a swirl generator for an evaporator, comprising: a swirl generator body that extends along a body-center axis between opposing inlet and outlet ends, the swirl generator body including a fluid inlet at the inlet end, wherein the swirl generator body includes an outer surface that, at that the outlet end, defines an outlet region that includes a curved outer boundary that forms a convex curve that extends radially inward from an outer diameter surface of the body to an outer axial surface of the body; a center passage formed within the swirl generator body that extends from the inlet towards the outlet along the body-center axis; and a swirl passage formed at the outlet end of the swirl generator body, the swirl passage extending between the center passage and the curved outer boundary along a swirl passage axis such that a fluid entering the center passage from the inlet end exits the swirl generator body at the curved outer boundary, wherein the swirl passage axis forms an acute angle with the body-center axis.

In addition to one or more of the above disclosed aspects or as an alternate the outer surface of the swirl generator body is cylindrical.

In addition to one or more of the above disclosed aspects or as an alternate the curved outer boundary is rounded.

In addition to one or more of the above disclosed aspects or as an alternate a center passage diameter is larger than a swirl passage diameter.

In addition to one or more of the above disclosed aspects or as an alternate the swirl generator body forms a plurality of swirl passages that are circumferentially offset from one another and axially aligned with one another.

In addition to one or more of the above disclosed aspects or as an alternate the outer surface of the swirl generator body defines a flange between the opposing ends of the swirl generator body.

In addition to one or more of the above disclosed aspects or as an alternate an outer diameter of the swirl generator body is larger on one side of the swirl generator body than another side of the swirl generator body.

Further disclosed is an evaporator assembly including: a header that defines an outlet port; an evaporator body that defines an evaporator passage in fluid communication with the outlet port; and a swirl generator, comprising: a swirl generator body that extends along a body-center axis between opposing inlet and outlet ends, the swirl generator body including a fluid inlet at the inlet end, wherein the swirl generator body includes an outer surface that, at that the outlet end, defines an outlet region that includes a curved outer boundary that forms a convex curve that extends radially inward from an outer diameter surface of the body to an outer axial surface of the body; a center passage formed within the swirl generator body that extends from the inlet towards the outlet along the body-center axis; and a swirl passage formed at the outlet end of the swirl generator body, the swirl passage extending between the center passage and the curved outer boundary along a swirl passage axis such that a fluid entering the center passage from the inlet end exits the swirl generator body at the curved outer boundary, wherein the swirl passage axis forms an acute angle with the body-center axis.

In addition to one or more of the above disclosed aspects or as an alternate the outlet port includes: a one portion that is sized to receive the evaporator body, wherein the one side of the swirl generator body is received within the evaporator passage; another portion that is sized to receive the other side of the swirl generator body; and an intermediate portion that is sized to receive the flange of the swirl generator.

In addition to one or more of the above disclosed aspects or as an alternate the curved outer boundary of the swirl generator body is adjacent to and at least partially faces a sidewall of the evaporator passage.

In addition to one or more of the above disclosed aspects or as an alternate the evaporator assembly further includes: a plurality of outlet ports formed within the header; a plurality of evaporator passages formed within the evaporator body in fluid communication with respective ones of the plurality of outlet ports, a plurality of swirl generators fluidly connected between the plurality of outlet ports and respective ones of the plurality of evaporator passages.

In addition to one or more of the above disclosed aspects or as an alternate the plurality of evaporator passages each have a grooved inner geometry or a smooth inner geometry.

Further disclosed is a method comprising: directing a fluid into a center passage of a swirl generator from an outlet port of an header; directing the fluid into a swirl passage defined by the swirl generator; directing the fluid into an evaporator passage of an evaporator body from the swirl passage; and forming a swirling fluid stream from the swirl passage, in which the fluid moves towards a sidewall of the evaporator passage and moves downstream along the evaporator passage.

In addition to one or more of the above disclosed aspects or as an alternate, directing the fluid into the center passage of the swirl generator includes directing the fluid into the center passage of respective ones of a plurality of swirl generators from respective ones of a plurality of outlet ports of the header.

BRIEF DESCRIPTION OF THE DRAWINGS

The present disclosure is illustrated by way of example and not limited in the accompanying figures in which like reference numerals indicate similar elements.

DETAILED DESCRIPTION

Aspects of the disclosed embodiments will now be addressed with reference to the figures. Aspects in any one figure is equally applicable to any other figure unless otherwise indicated. Aspects illustrated in the figures are for purposes of supporting the disclosure and are not in any way intended on limiting the scope of the disclosed embodiments. Any sequence of numbering in the figures is for reference purposes only.

In a thermal management system, the evaporator utilizes the latent heat of the fluid to absorb waste heat from the heat source. After vaporizing, a vapor phase of the working fluid occupies most of the space inside the evaporator. In the case of removing heat from a large footprint area, the evaporator will be designed to have multiple parallel flow passages which allows the working fluid to be vaporized with reasonable pressure drop and temperature uniformity. In a parallel flow passage design, a flow distribution is a factor determining the overall evaporator performance.

Figure 1:
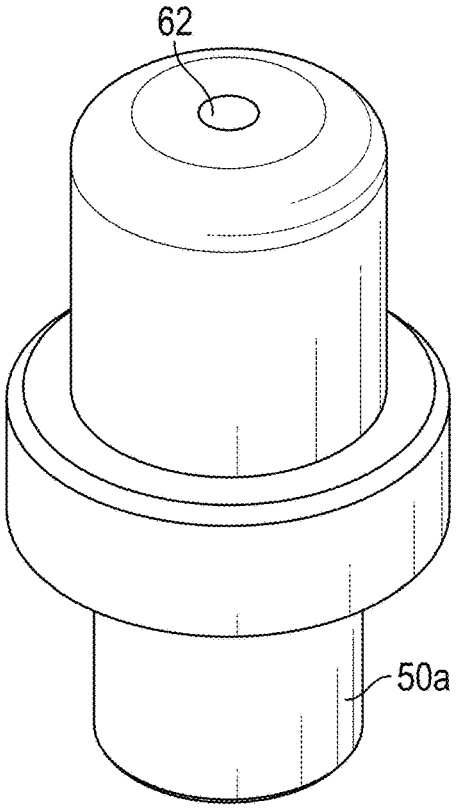
FIG. 1 (Prior Art)
FIG. 1 is an isometric view of a prior art insert for an evaporator.
Figure 2:
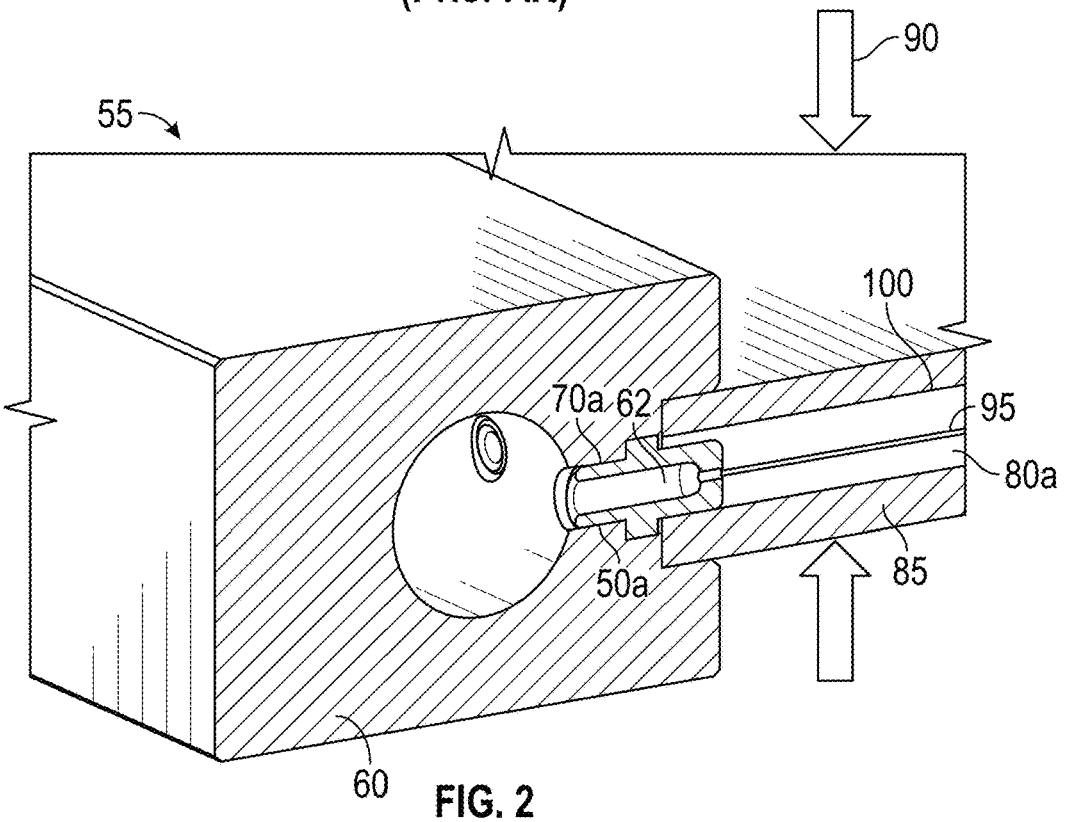
FIG. 2 (Prior Art)
FIG. 2 is a cross sectional view of an evaporator equipped with the insert of FIG. 1.

FIG. 1 shows an insert 50*a*, known in the art, for an evaporator assembly 55 (FIG. 2). An insert-passage 62 is located at the center of the insert 50*a*. In FIG. 2, the evaporator assembly 55 includes a header 60 that defines a plurality of outlet ports generally referred to as 70, one of which 70*a* is shown in a cross section. An evaporator body 85 includes a plurality of evaporator passages generally referred to as 80, one 80*a* of which is illustrated in cross section. The evaporator passages 80 are generally parallel to one another in the evaporator body 85.

A plurality of inserts generally referred to as 50 are disposed in respective ones of the plurality of outlet ports 70. One insert 50*a*, which is the insert 50*a* of FIG. 1, is illustrated in cross section. Through the plurality of inserts 50, the respective ones of the plurality of outlet ports 70 may fluidly connect to respective ones of the plurality of evaporator passages 80. Heat energy 90 may be applied to either side or both sides of the evaporator body 85. To achieve uniform flow distribution in the parallel flow passages design, the plurality of inserts 50 are commonly used to create desired back pressure at the entrance of the plurality of evaporator passages 80.

The flow lines 95 illustrated in FIG. 2 indicate the fluid flow direction through the insert-passage 62 and inside the evaporator passage 80*a* in a microgravity environment, such as in an aerospace application. Undisturbed fluid may flow mostly in a straight line without contacting a sidewall 100 of the evaporator passage 80*a*. In order to have an efficient operation, the fluid phase of the working fluid should contact the sidewall 100 of the evaporator passage 80*a* along an entire length of the evaporator passage 80*a*. Otherwise, available heat along the full length of the sidewall 100 may remain in the evaporator body 85. This is inefficient and may result in damage to the evaporator body 85.

Figure 3B:
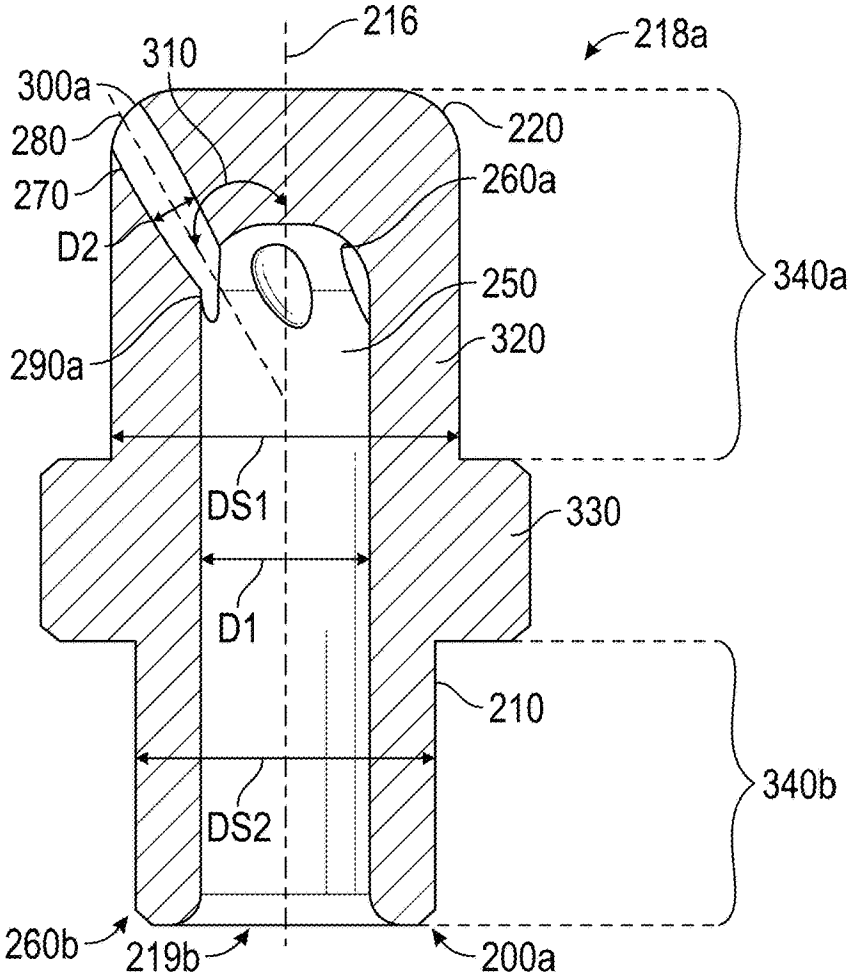
FIG. 3*b* is a cross-sectional view of the swirl generator of FIG. 3*a* taken along lines A-A in FIG. 3*a*, according to an embodiment.
Figure 3A:
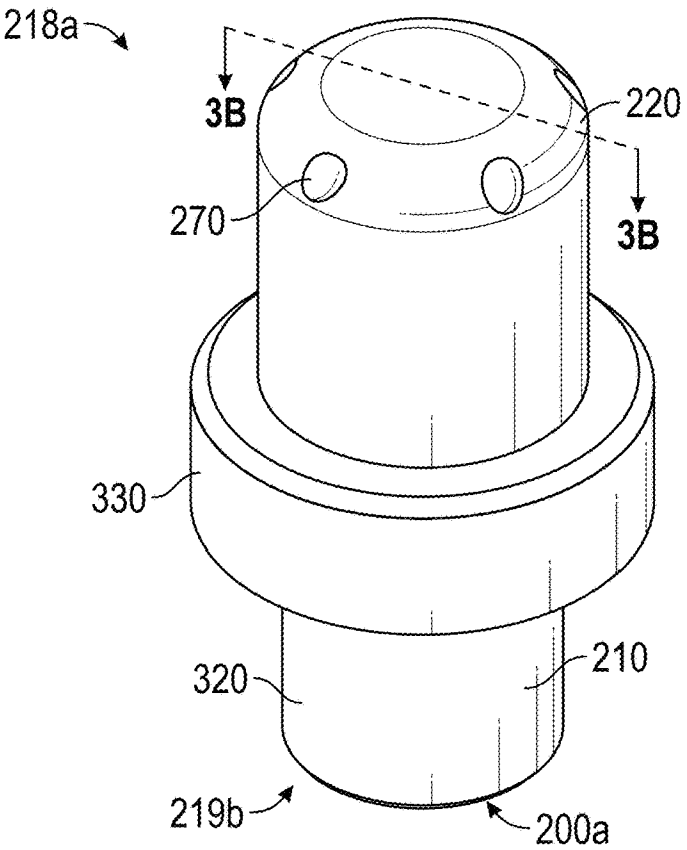
FIG. 3*a* is an isometric view of a swirl generator, according to an embodiment.

In view of the above identified concerns, turning to FIGS. 3*a* and 3*b* a swirl generator 200*a* is disclosed herein. The swirl generator 200*a* includes a swirl generator body 210 that extends along a body-center axis 216 between opposing ends (inlet and outlet ends) generally referred to as 218. The swirl generator body 210 is illustrated as being cylindrical though other shapes are within the scope of the disclosure. A curved outer boundary 220 is defined by an outer surface 230 of the swirl generator body 210 at the outlet end 218*a* of the swirl generator body 210.

The curved outer boundary 220 is illustrated as a rounded edge, such as a fillet, though other shapes are within the scope of the disclosure. A center passage 250 having opposing ends (inlet and outlet ends) generally referred to as 260 is defined by the swirl generator body 210, and which extends along the body-center axis 216. The outlet end 260*a* of the center passage 250 is intermediate the opposing ends 218 of the swirl generator body 210. The inlet end 260*b* of the center passage 250 is disposed on the body-center axis 216. The center passage 250 identified herein may be formed at least initially, that is before additional passages (identified below) are fabricated in the swirl generator 200*a*, as blind hole. As would be understood by one of ordinary skill, a blind hole refers to a hole that is reamed, drilled, or milled to a specified depth without breaking through to the other side of a workpiece.

A swirl passage 270*a* is defined by the swirl generator body 210. The swirl passage 270*a* extends between the outlet end 260*a* of the center passage 250 and the curved outer boundary 220. The swirl passage 270*a* defines a swirl-passage axis 280 extending between a swirl passage inlet 290*a* and a swirl passage outlet 300*a*. The swirl passage inlet 290*a* is defined at the outlet end 260*a* of the center passage 250 and the swirl passage outlet 300*a* is defined on the curved outer boundary 220.

Figure 4:
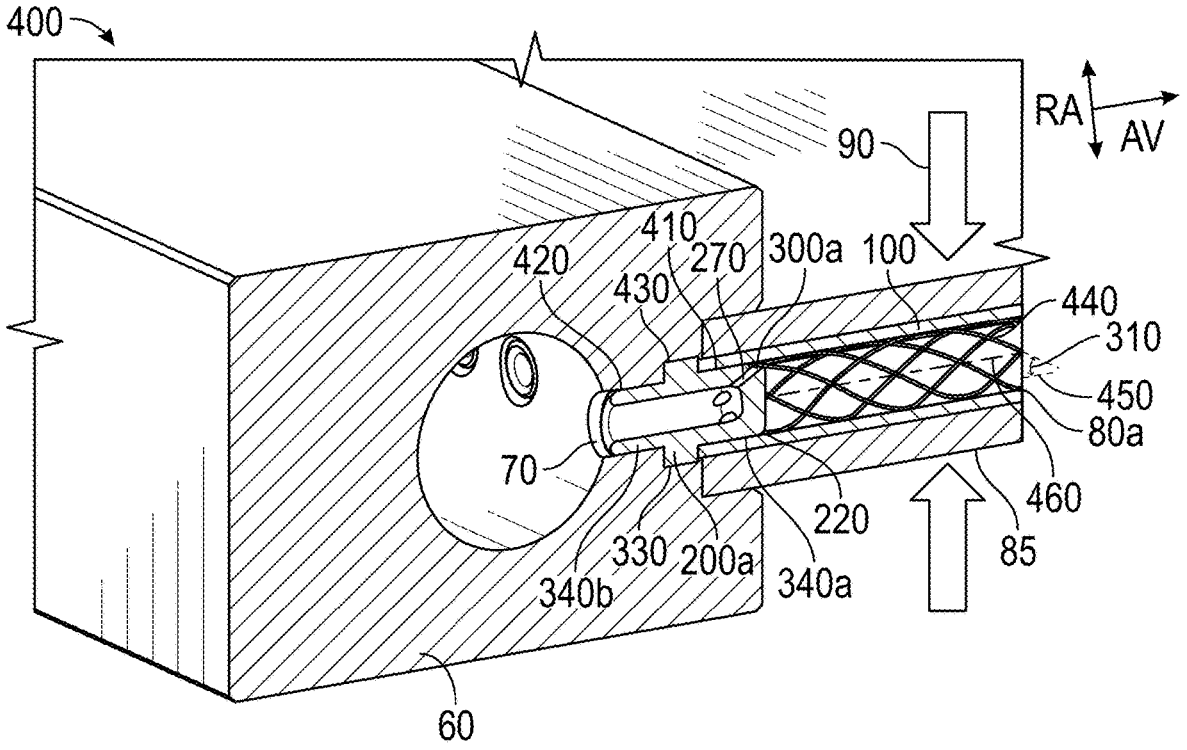
FIG. 4 is a cross sectional view of an evaporator equipped with the swirl generator at the evaporator inlet.

The body-center axis 216 and the swirl-passage axis 280 are oriented at an angle 310, which may be an acute angle with respect to the body-center axis 216. Thus, as will be explained below, the swirl passage 270*a* is designed to tangentially face the sidewall 100 of the evaporator passage 80*a* (FIG. 4). A center passage diameter D1 is larger than a swirl passage diameter D2. This way, fluid is throttled through the swirl passage 270*a* from the center passage 250.

The outer surface 320 of the swirl generator body 210 defines a flange 330 between the opposing ends 218 of the swirl generator body 210. The flange 330 partitions the swirl generator 200*a* into opposing sides generally referred to as 340. One side 340*a* of the swirl generator body 210 is between the flange 330 and the outlet end 218*a* of the swirl generator body 210. Another side 340*b* of the swirl generator body 210 is between the flange 330 and the inlet end 218*b* of the swirl generator body 210. The flange 330 is used, as indicated below, for seating of the swirl generator 200*a* between the header 60 and the evaporator body 85 in the outlet port 70*a*. An outer diameter DS1 of the swirl generator body 210 is larger on the one side 340*a* of the swirl generator body 210 than the diameter DS2 of the other side 340*b* of the swirl generator body 210. The configuration of the outer surface 320 of the swirl generator body 210, as indicated below, enables a proper fitting between the header 60, the swirl generator 200*a* and the evaporator body 85. However this configuration is not intended on limiting the relative sizing of the opposing sides 340 of the swirl generator body 210 relative to each other and the flange 330. In addition, in certain embodiments a flange 330 is not provided.

As illustrated, the swirl generator 200*a* includes a plurality of swirl passages generally referred to as 270. The outlet end 260*a* of the center passage 250 defines a plurality of swirl passage inlets generally referred to as 290. The curved outer boundary 220 defines a plurality of swirl passage outlets generally referred to as 300. As illustrated, the outlet end 260*a* of the center passage 250 and the curved outer boundary 220 are each annular. With the illustrated configuration, the plurality of swirl passages 270 are circumferentially offset from one another and axially aligned with one another along the body-center axis 216.

FIG. 4 shows an evaporator assembly 400 which is similar to the evaporator assembly 55*a* of FIG. 2 except as identified. The evaporator assembly 400 includes the header 60 that defines the plurality of outlet ports 70, one 70*a* of which is illustrated in cross section. The evaporator body 85 defines the plurality of evaporator passages 80, one of which 80*a* is illustrated in cross section. The plurality of outlet ports 70 are in fluid communication with respective ones of the plurality of evaporator passages 80. Heat can be applied to either side or both sides of the evaporator body 85. A plurality of swirl generators generally referred to as 200 are disposed in respective ones of the plurality of outlet ports 70. One swirl generator 200*a*, which is the swirl generator 200*a* of FIGS. 3*a* and 3*b*, is illustrated in cross section. Through the plurality of swirl generators 200, the respective ones of the plurality of outlet ports 70 may fluidly connect to respective ones of the plurality of evaporator passages 80.

The outlet port 70*a* in the header includes one portion 410 that is sized to receive the evaporator body 85. As indicated, the one side 340*a* of the swirl generator body 210 is received within the evaporator passage 80*a*. Another portion 420 of the outlet port 70*a* is sized to receive the other side 340*b* of the swirl generator body 210. An intermediate portion 430 of the outlet port 70*a* is sized to receive the flange 330 of the swirl generator 200*a*. The flange 330 prevents movement of the swirl generator 200*a* relative to the header 60 and the evaporator body 85. The evaporator passage 80*a* has a larger flow area than the one portion 410 of the outlet port 70*a*. Therefore, as indicated, the one side 340*a* of the swirl generator body 210 has a larger diameter than the other side 340*b* of the swirl generator body 210. However, as indicated, this configuration is not intended on limiting the relative sizing of the opposing sides 340 of the swirl generator body 210.

The curved outer boundary 220 of the swirl generator body 210, and thus the swirl passage outlet 300*a*, is adjacent to and at least partially faces the sidewall 100 of the evaporator passage 80*a*. This configuration enables the creation of a swirl flow 440 within the evaporator passage 80*a*. That is, after flowing into the swirl generator 200*a*, the single-phase liquid or two-phase fluid is guided into the plurality of swirl passages 270. The fluid exits the swirl generator 200*a* along a tangential direction relative to the flow path 450 of the fluid and with the angle 310 with respect to the centerline 460 of the evaporator passage 80*a*. Due to the orientation of the plurality of swirl passages 270, the fluid exiting the swirl generator 200*a* will have both an axial velocity component AV and a radial velocity component RV relative to the geometry of the evaporator passage 80*a*. Once inside the evaporator passage 80*a*, the radial flow velocity component RV moves the fluid towards a sidewall 100 of the evaporator passage 80*a* and the axial velocity component AV moves the fluid downstream in the evaporator passage 80*a*.

Figure 5A:
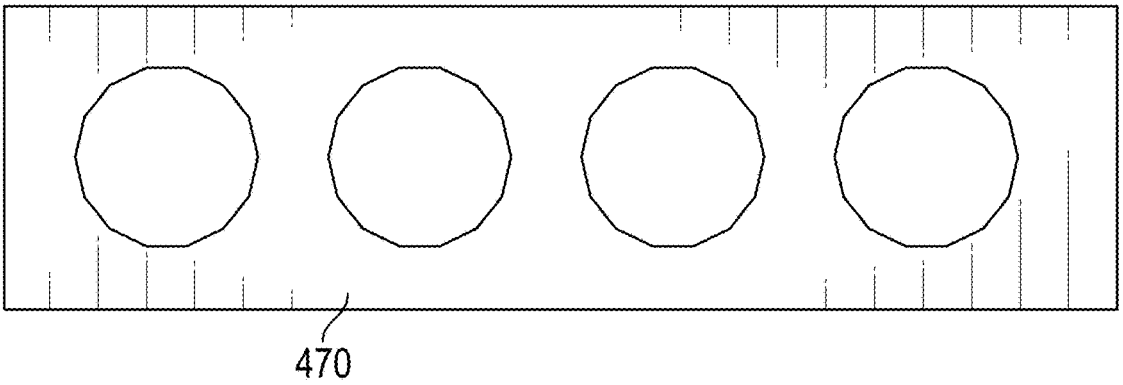
FIGS. 5*a* and 5*b* show different evaporator flow passage surface, including a smooth surface and a grooved surface, respectively.
Figure 5B:
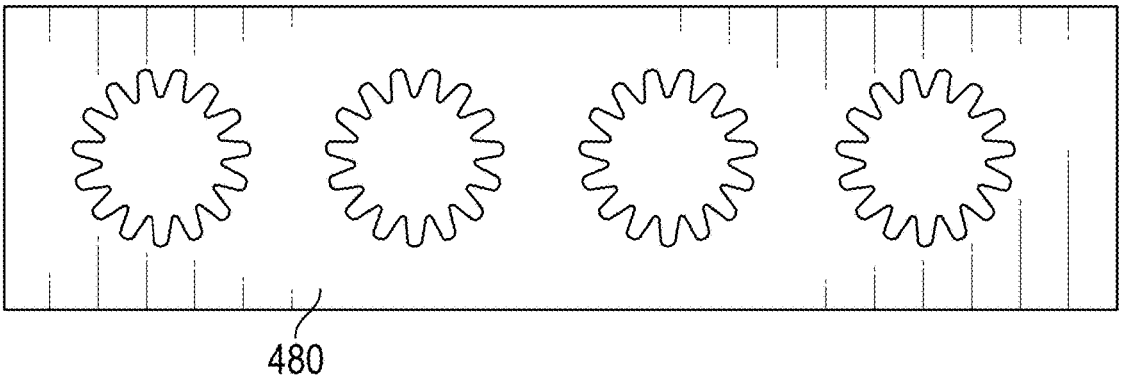

The swirl generator 200*a* may be used in different types of evaporator assemblies for example with evaporator bodies having different flow passage geometries. Two exemplary evaporator bodies 470, 480, defining respective evaporator flow passage surfaces having a smooth inner geometry and a grooved inner geometry, are respectively shown in FIGS. 5*a* and 5*b*. It should be noted that a variety of flow passage geometries may be implemented and fit within the scope of the present disclosure.

The disclosed embodiments provide an efficient evaporation process inside an evaporator and result in a more uniform temperature distribution on outside surface of the evaporator.

Figure 6:
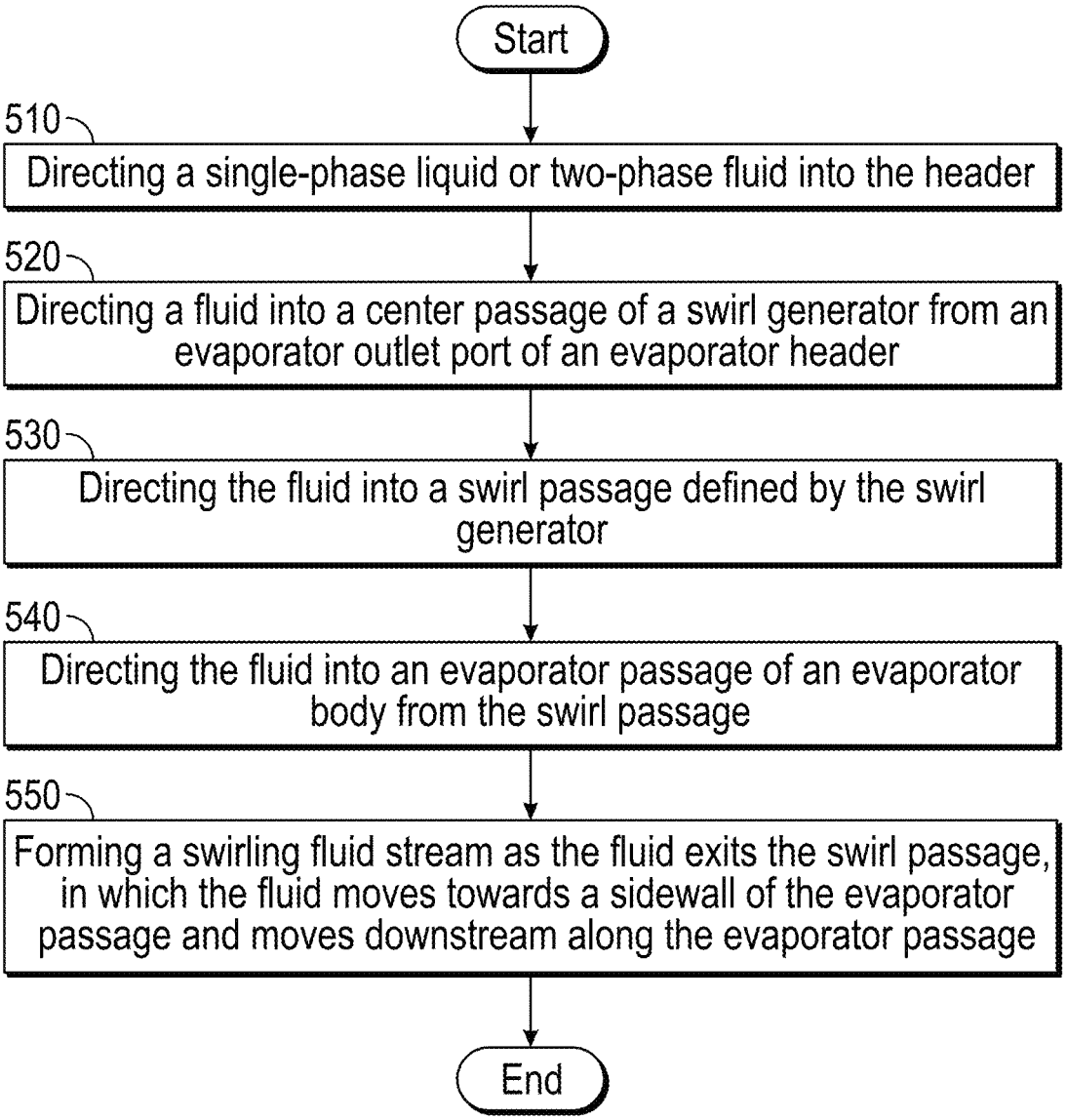
FIG. 6 is a flowchart showing a method of evaporating a single-phase liquid or two-phase fluid with an evaporator assembly.

Turning to FIG. 6, a method is disclosed for evaporating a single-phase liquid or two-phase fluid with the evaporator assembly 400. As show in block 510 the method includes directing a single-phase liquid or two-phase fluid into the header 60. Block 520 shows that the method includes directing the fluid into the center passage 250 of the swirl generator 200*a* from the outlet port 70*a* of the header 60. As shown in block 530 the method includes directing the fluid into the swirl passage 270*a* defined by the swirl generator 200*a*.

As shown in block 540 the method includes directing the fluid into the evaporator passage 75*a* of the evaporator body 85, from the swirl passage 270*a*. As shown in block 550 the method includes forming a swirling fluid stream as the fluid exits the swirl passage 270*a*. From this configuration the fluid moves towards the sidewall 100 of the evaporator passage 80*a* and moves downstream along the evaporator passage 80*a*.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An evaporator assembly including:

a header that defines an outlet port;

an evaporator body that defines an evaporator passage in fluid communication with the outlet port; and a swirl generator, comprising:

a swirl generator body that extends along a body-center axis between opposing inlet and outlet ends, the swirl generator body including a fluid inlet at the inlet end, wherein the swirl generator body includes an outer surface that, at that the outlet end, defines an outlet region that includes a curved outer boundary that forms a convex curve that extends radially inward from an outer diameter surface of the body to an outer axial surface of the body;

a center passage formed within the swirl generator body that extends from the inlet towards the outlet along the body-center axis; and a swirl passage formed at the outlet end of the swirl generator body so as to face the evaporator body, the swirl passage extending between the center passage and the curved outer boundary along a swirl passage axis such that a fluid entering the center passage from the inlet end exits the swirl generator body at the curved outer boundary, wherein the swirl passage axis forms an acute angle with the body-center axis.

2. The evaporator assembly of claim 1, wherein the outer surface of the swirl generator body is cylindrical.

3. The evaporator assembly of claim 1, wherein the curved outer boundary is rounded.

4. The evaporator assembly of claim 1, wherein a center passage diameter is larger than a swirl passage diameter.

5. The evaporator assembly of claim 1, wherein the swirl generator body forms a plurality of swirl passages that are circumferentially offset from one another and axially aligned with one another.

6. The evaporator assembly of claim 1, wherein the outer surface of the swirl generator body defines a flange between the opposing ends of the swirl generator body.

7. The evaporator assembly of claim 1, wherein an outer diameter of the swirl generator body is larger on one side of the swirl generator body than another side of the swirl generator body.

8. The evaporator assembly of claim 7, wherein the outlet port includes:

a one portion that is sized to receive the evaporator body, wherein the one side of the swirl generator body is received within the evaporator passage;

another portion that is sized to receive the other side of the swirl generator body; and an intermediate portion that is sized to receive the flange of the swirl generator.

9. The evaporator assembly of claim 1, wherein the curved outer boundary of the swirl generator body is adjacent to and at least partially faces a sidewall of the evaporator passage.

10. The evaporator assembly of claim 1, further including:

a plurality of outlet ports formed within the header;

a plurality of evaporator passages formed within the evaporator body in fluid communication with respective ones of the plurality of outlet ports, a plurality of swirl generators fluidly connected between the plurality of outlet ports and respective ones of the plurality of evaporator passages.

11. The evaporator assembly of claim 10, wherein the plurality of evaporator passages each have a grooved inner geometry or a smooth inner geometry.

12. A method of utilizing the evaporator assembly of claim 1, the method comprising:

directing the fluid into the center passage of the swirl generator from the outlet port of the header;

directing the fluid into the swirl passage defined by the swirl generator;

directing the fluid into the evaporator passage of the evaporator body from the swirl passage; and forming a swirling fluid stream from the swirl passage, in which the fluid moves towards the sidewall of the evaporator passage and moves downstream along the evaporator passage.

13. The method of claim 12, wherein directing the fluid into the center passage of the swirl generator includes directing the fluid into the center passage of respective ones of a plurality of swirl generators from respective ones of a plurality of outlet ports of the header.

* * * * *